US007966687B2

(12) United States Patent
Rahbar-Dehghan

(10) Patent No.: US 7,966,687 B2
(45) Date of Patent: Jun. 28, 2011

(54) ANTI-SMEAR CLEANING SWAB WITH PERFORATED BLADE

(75) Inventor: Fariborz Rahbar-Dehghan, Canmore (CA)

(73) Assignee: 1317442 Alberta Ltd., Canmore, Alberta (CA)

( * ) Notice: Subject to any disclaimer, the term of this patent is extended or adjusted under 35 U.S.C. 154(b) by 635 days.

(21) Appl. No.: 11/996,808

(22) PCT Filed: Mar. 22, 2007

(86) PCT No.: PCT/CA2007/000468

§ 371 (c)(1),
(2), (4) Date: Jan. 25, 2008

(87) PCT Pub. No.: WO2007/112550

PCT Pub. Date: Oct. 11, 2007

(65) Prior Publication Data

US 2008/0209654 A1 Sep. 4, 2008

Related U.S. Application Data

(60) Provisional application No. 60/788,113, filed on Apr. 3, 2006.

(51) Int. Cl.
*A47L 13/16* (2006.01)
*A47L 25/00* (2006.01)

(52) U.S. Cl. ..... 15/209.1; 15/210.1; 15/118; 15/104.94; 604/1

(58) Field of Classification Search ..... 15/104.94, 15/118, 209.1, 210.1, 244.1, 244.3; 604/1
See application file for complete search history.

(56) References Cited

U.S. PATENT DOCUMENTS

| | | | | | |
|---|---|---|---|---|---|
| 1,252,316 | A | * | 1/1918 | Bascom | 15/218.1 |
| 1,318,964 | A | * | 10/1919 | Chess | 15/210.1 |
| 1,857,145 | A | * | 5/1932 | Funk | 604/1 |
| 1,973,093 | A | * | 9/1934 | Moore | 15/210.1 |
| 2,510,490 | A | * | 6/1950 | Ager | 604/1 |
| 2,815,521 | A | * | 12/1957 | Winckler | 15/118 |
| 2,842,790 | A | * | 7/1958 | Castelli | 15/143.1 |
| 3,058,139 | A | * | 10/1962 | Dryden | 15/244.1 |
| 3,105,263 | A | * | 10/1963 | Ginter | 15/244.1 |
| 3,366,988 | A | * | 2/1968 | Ginter et al. | 15/244.1 |
| 3,394,702 | A | * | 7/1968 | Heimlich et al. | 604/1 |
| 3,508,547 | A | * | 4/1970 | Deuschle | 604/1 |
| 4,887,994 | A | * | 12/1989 | Bedford | 604/1 |
| 4,889,441 | A | | 12/1989 | Tice | |
| 4,934,011 | A | | 6/1990 | Haug | |
| 5,212,847 | A | * | 5/1993 | Melcher et al. | 15/244.1 |

(Continued)

FOREIGN PATENT DOCUMENTS

WO WO/2004/060106 7/2004

*Primary Examiner* — Mark Spisich
(74) *Attorney, Agent, or Firm* — Fraser Clemens Martin & Miller LLC; J. Douglas Miller

(57) ABSTRACT

An anti-smear cleaning swab for cleaning delicate surfaces, comprising a body defining an elongated shaft having two opposite ends. An enlarged blade is carried at one end of the handle. A number of bores are made through the blade, these bores enabling both fluid flow therethrough and also some retensive capture of fluid droplets. A fluid absorbing cloth sheet pocket generally encloses by folding same around the blade, and is sized to fit snugly therearound.

8 Claims, 4 Drawing Sheets

U.S. PATENT DOCUMENTS 5,240,339 A 8/1993 Deforest et al.
5,592,713 A * 1/1997 Rones ..... 15/210.1
5,671,497 A 9/1997 Abdo
5,774,925 A * 7/1998 Pryor, III ..... 15/244.1
5,931,591 A 8/1999 Mccracken
5,991,960 A 11/1999 Johnson
6,134,742 A * 10/2000 Fernando et al. ..... 15/231
6,449,795 B1 * 9/2002 Sato ..... 15/210.1
6,601,264 B1 * 8/2003 Hendricks ..... 15/244.1
7,320,181 B2 1/2008 Charpentier
2004/0088808 A1 * 5/2004 Vitantonio et al. ..... 15/104.94
2005/0055789 A1 3/2005 Kubes et al.

* cited by examiner

ANTI-SMEAR CLEANING SWAB WITH PERFORATED BLADE

CROSS-REFERENCE DATA

This application claims the conventional priority of provisional patent application No. 60/788,113 in the United States filed Apr. 3, 2006

BACKGROUND OF THE INVENTION

Digital cameras comprise a sensor chamber in which is lodged an electronic sensor, such as a charge-coupled device (CCD) sensor or Complementary Metal Oxide Semiconductor (CMOS) sensor, onto which is projected the image of what is seen through the lens of the camera. This sensor can acquire the image projected thereon and convert it into electronic data, which is thereafter forwarded to data processing means provided on the digital camera. The data processing means then converts this electronic data into an image file of known format, such as in JPEG, TIFF or RAW formats, stored thereafter on the memory card of the camera. Of course, this sensor must remain as clean as possible, since impurities deposited thereon can undesirably alter the final image acquired by the camera.

It is inevitable that during normal use of a digital camera, its sensor will become exposed to the atmosphere and its airborne impurities, such as minute airborne dust particles. More particularly, on digital cameras having interchangeable lenses such as digital single-lens reflex (DSLR) cameras, the sensor inevitably becomes exposed to the atmosphere and its impurities whenever the lens is removed from the body of the camera, for example when switching lenses.

To clean the sensor of their digital cameras, digital camera owners have come up with a number of cleaning methods. One cleaning method consists in swabbing the camera sensor with a lint-free cleaning swab wetted with a few drops of dedicated cleaning liquid. Certain prior art cleaning swabs for digital camera sensors comprise a paddle-shaped rigid body defining an elongated handle and a sweeping blade integrally carried at one end of handle. A piece of lint-free cloth is wrapped around and carried by sweeping blade. In one particular embodiment of these prior art cleaning swabs, lint-free cloth is bag-shaped and slipped around sweeping blade, and is tightly held thereon by an elastic band.

To use the swab, the user wets the lint-free cloth with a few drops of cleaning fluid. Thereafter, the cloth-covered sweeping blade is brought into the sensor chamber of is camera, into which the sensor is located, and the user gently scrubs the surface of the sensor therewith. The cleaning liquid wetting cloth dissolves dried specks that may be present on the sensor's surface, such as dried saliva drops blown on the camera's sensor when the camera's owner was switching lenses for example. As the swab is swept across the digital camera sensor, the swab picks up and removes the dust particles and dissolved specks from the sensor surface. The cleaning swab is then withdrawn from the camera's sensor chamber and the cleaning fluid spread on the sensor's surface evaporates.

These paddle-shaped swabs exhibit an annoying disadvantage. These swabs, when used, are generally held in downwardly inclined fashion with their sweeping head pointing downwardly towards the camera's sensor. Thus, when the user wets cloth with cleaning fluid and orients the cleaning swab downwardly so as to direct it towards his camera's sensor chamber, the excess cleaning liquid not absorbed by the fibres of the cloth drips under the influence of gravity against the continuous and impervious surface of the handle's sweeping blade-shaped sweeping blade towards its outer edge. The excess cleaning fluid flowing towards the sweeping blade edge soaks the contact edge of the cloth, and can sometimes seep through and start dripping off the contact edge of cloth. Therefore, excess cleaning fluid can drip onto the camera sensor, or can be pressed out the soaked contact edge when it is swept across the surface of the sensor, resulting in an excessive amount of fluid being smeared onto the surface of the sensor. Moreover, it could be difficult for this excess cleaning liquid to be resorbed into the cloth since the latter's contact edge is already saturated with liquid. The swab is then withdrawn from the sensor chamber. The cleaning fluid can then evaporate, but since an excessive amount of cleaning fluid has been discharged from the cloth and left onto the sensor surface, the evaporation thereof has the tendency to leave streak marks on the surface of the sensor, something that is highly undesirable since such marks can alter the performance of the sensor, in particular the sharpness of the images captured by the sensor.

SUMMARY OF THE INVENTION

In accordance with the teachings of the invention, there is disclosed an anti-smear cleaning swab for cleaning delicate surfaces, comprising a body defining an elongated handle having one end and another end opposite said one end thereof, an enlarged blade edgewisely carried at said handle one end and having one face and another face opposite said one face and a peripheral edge joining said one face and said another face, channel means provided integral to said blade and enabling fluid flow about at least one of said one face and of said another face of said blade, and a fluid absorbing pocket generally enclosing said one blade and sized to fit snugly therearound.

Preferably, said channel means consists of at least a few passageways extending through said one blade and opening into said one face and into said another face of said blade. Preferably, at least some of said passageways are sized and shaped to enable fluid droplet retensive capture between said one face and said another face of said blade. Said passageways could be selected from the group comprising circular holes, oblong channels, and slots; or alternately or concurrently, from the group comprising grooves made on at least one of said one face and another face of said blade, and protrusions (e.g. spikes) integrally projecting from at least one of said one face and another face of said blade.

Preferably, there is provided an elongated groove, extending lengthwisely of said handle, said handle groove cooperating with said blade channel means in promoting fluid escape from said fluid absorbing pocket, preferably under capillary forces whereby said handle groove is suitably sized and shaped therefor.

Said fluid absorbing pocket could be made from a piece of folded lint-free sheet fabric, positioned relative to said blade such that a fold line of said sheet fabric is positioned adjacent a substantial portion of said blade peripheral edge, said sheet fabric being secured to said blade by hot sealing of a small fraction of said blade peripheral edge.

Alternately, said fluid absorbing pocket could be made from a piece of folded lint-free sheet fabric, positioned relative to said blade such that a fold line of said sheet fabric is positioned adjacent a substantial portion of said blade peripheral edge, said sheet fabric to be sewn to said blade by a thread passing through a small portion of said sheet fabric and hookingly passing through not more than a few of said blade passageways.

In an alternate embodiment of the invention, there is provided an anti-smear cleaning swab for cleaning delicate surfaces, comprising a body defining an elongated cross-sectionally quadrangular rigid handle having one end and another end opposite said one end thereof, a first enlarged rigid blade carried at said handle one end and having one face and another face opposite said one face and a peripheral edge joining said one face and said another face, a second enlarged rigid blade carried at said handle another end and having one face and another face opposite said one face and a peripheral edge joining said one face and said another face; channel means provided integral to said one blade and enabling fluid flow about at least one of said one face and said another face of said blade, and a fluid absorbing pocket generally enclosing said one blade and sized to fit snugly therearound.

DETAILED DESCRIPTION OF THE EMBODIMENTS

Figure 1:
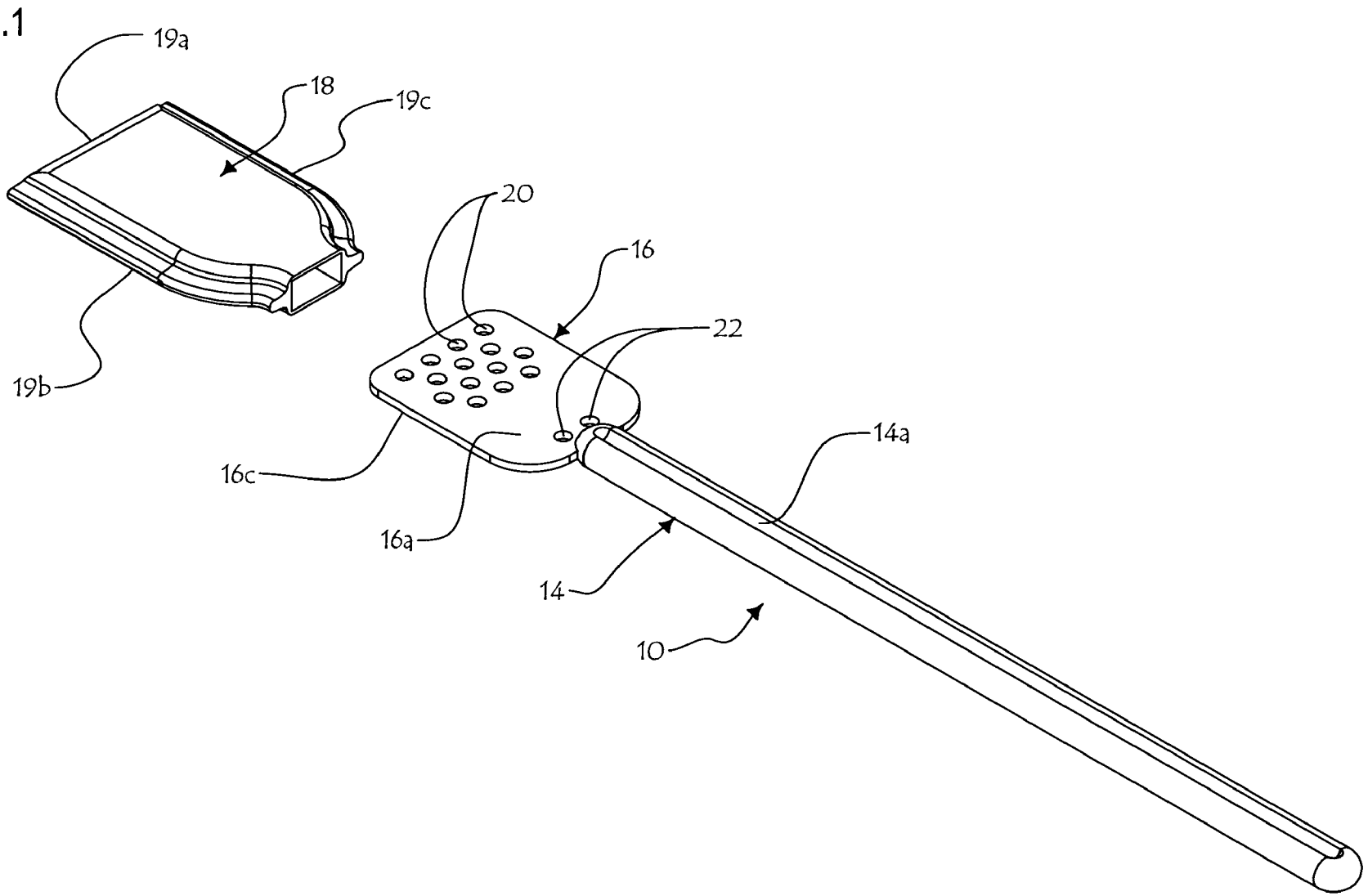
FIG. 1 is an exploded perspective view of a first embodiment of cleaning swab according to the present invention.
Figure 2:
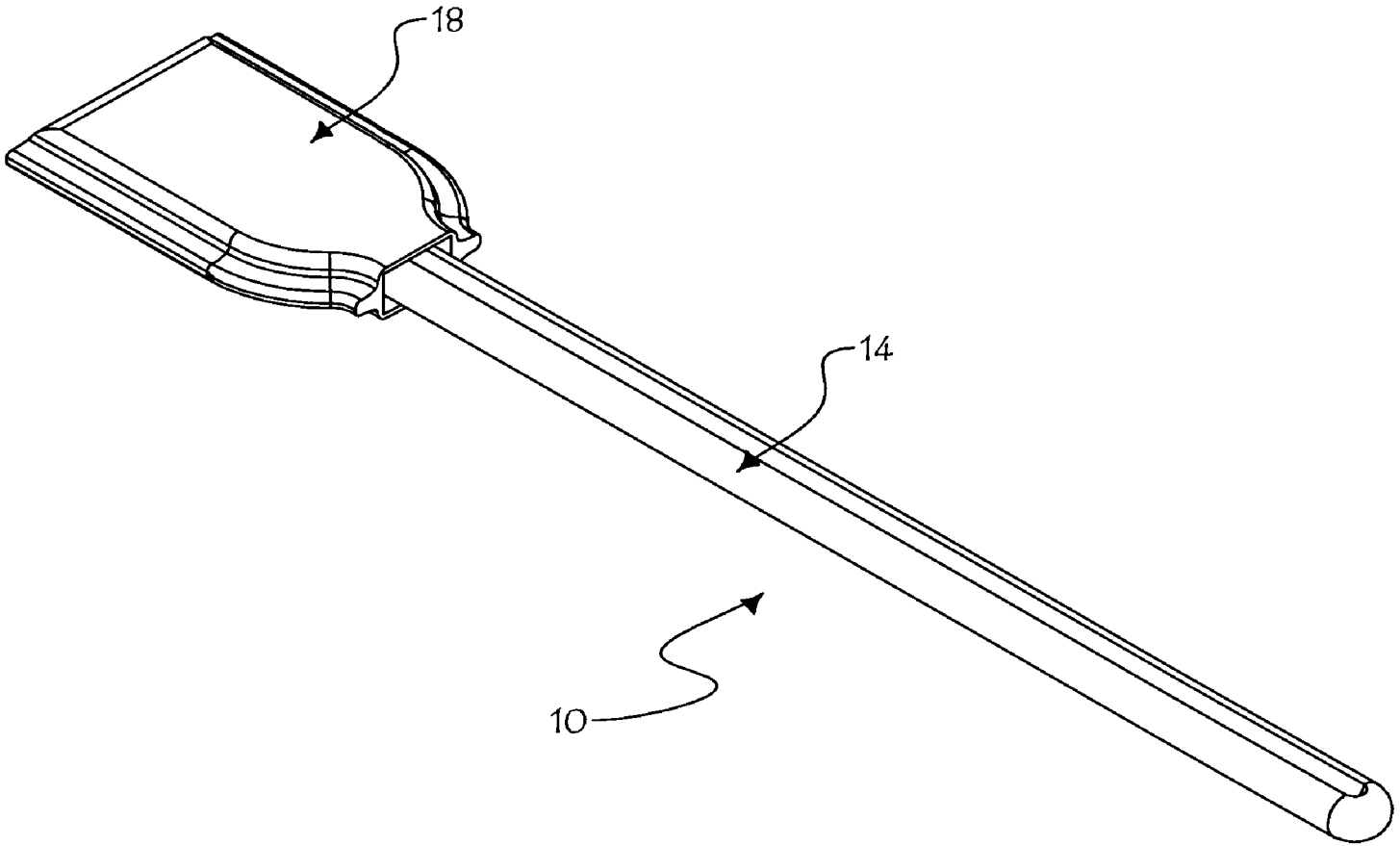
FIG. 2 is a view similar to FIG. 1, but with the cleaning swab in assembled condition.

A first embodiment of cleaning swab 10 is shown in FIGS. 1-2 of the drawings, and comprises a body, for example of paddle shape, having a generally rigid elongated shaft handle 14, at one end of which is edgewisely affixed a wider sweeping flat blade 16. Handle 14 may be cylindrical (as shown in FIGS. 1-2), cross-sectionally quadrangular (for example, cross-sectionally rectangular, in FIG. 3), or other suitable shapes. Blade 16 includes one and another opposite faces 16*a*, 16*h* (FIGS. 1 and 4), and a peripheral edge 16*c* (FIG. 1). Blade 16 further carries fluid channel means 20. In the embodiment of FIGS. 1-2, fluid channel means consists of a number of perforations or holes 20 made transversely of blade 16. As illustrated in FIG. 4, channel means 20 could alternately consist of slots or "mini-channels", 30, or other apertures (for example, ovoidal apertures 32) extending through blade 16; or alternately and/or concurrently, channel means 20 could consist of protrusions 34 (like spikes), grooves 36, or ridges 38 made on at least one surface of the blade 16. Furthermore, a pair of sew holes 22 are preferably made on blade 16, in the vicinity of its junction with handle 14.

The cleaning swab 10 can be provided with a sweeping blade 16 of various widths. Thus, a camera owner can select a cleaning swab 10 having a blade width corresponding to his sensor size.

Cleaning swab 10 further comprises a pocket member 18 sized to fit snugly around blade 16. Blade 16 should be at least semi-rigid. Pocket member 18 is preferably made from sheet fabric. The fabric used in the confection of pocket member 18 can be any suitable lint-free fabric or cloth, and can be chosen in function of its compatibility with the specific cleaning fluid it is destined to be used with. The attachment of pocket member 18 to blade 16 can be achieved in a number of different suitable manners. In the embodiment shown in FIGS. 1-2, pocket member 18 is a piece of fabric folded over blade 16 along a fold line which forms contact edge 19*a*, with opposite lateral edges 19*b*, 19*c* of the folded piece of fabric being cut to shape and adhered together by hot-sealing. This method can be used for cloths made with fabrics permitting hot-sealing, such as polyester or nylon fabrics, or other polymer-fibre fabrics.

Alternately, pocket member 18 could consist of a piece of fabric folded over blade 16 and sewn in place by a thread passing through a sheet cloth flap of pocket member 18 and through sew holes 22 made in blade 16. This fastening method is especially advantageous when the pocket member cloth is made of a fabric that does not allow hot-sealing, such as cellulose, cotton or rayon.

It is highly desirable that the blade leading edge, i.e. the contact edge 19*a* of blade 16 opposite shaft handle 14, be formed of a fold in the fabric rather than by a hot-seal joint. Indeed, hot sealing forms relatively rough and sharp joints which are more likely to scratch delicate surfaces than a smooth and continuous fold line. Nevertheless, it is understood that the present invention is not limited to cleaning swabs having a lint-free cloth formed of a folded piece of fabric.

Cleaning swab 10 is used in the same way than the prior art cleaning swab 10 described in the hereinabove "background of the invention" paragraph". The user wets the lint-free cloth 18 with a few drops of cleaning fluid, and the swab is ready for use on the sensor. With the present invention, when cleaning fluid is dropped on one side of the cloth of pocket member 18, it permeates across the cloth, and can pass through the holes 20 in order to reach the other side of the fabric and thus ensure homogeneous wetting of the cloth.

Moreover, with the swab of the present invention, if the cloth of pocket member 18 is wetted by an excessive amount of cleaning fluid, the liquid can be retained in fluid pockets formed by holes 20 within the thickness of blade 16, and thus prevented from running towards the blade's peripheral edge 16*c* and thus towards cloth contact edge 19*a*. It therefore prevents excessive amounts of liquid to be discharged onto the sensor surface when the swab with oversaturated cloth pocket member 18 is swept thereon.

Moreover, the fluid droplet retaining action of holes 20 allows the swab to remain wet for longer periods of times without having to pour additional cleaning fluid on the cloth of pocket member 18. Indeed, holes 20 are preferably sized and shaped to enable fluid droplets retensive capture in relation to the density of the fluid absorbed by the cloth make-up of pocket member 18. Therefore, the cleaning fluid previously dropped onto lint-free cloth of pocket member 18 and accumulated in retaining holes 20 can gradually be transferred to the lint-free cloth as soon as cloth of pocket member 18 starts to dry out, thus preventing premature dry up of the cleaning swab.

An elongated groove 14*a* may be made along handle 14. Groove 14*a* may be provided to promote fluid escape from the damp pocket member 18. In one embodiment, groove 14*a* could be sized and shaped to enable passive fluid motion under capillary forces from oversaturated cloth pocket member 18 along handle 14 away from blade 16.

Since cleaning fluids for digital camera sensors are designed to evaporate rapidly in order to prevent lengthy wetting of the camera sensor, this accumulation and continuous distribution of cleaning fluid in the cloth is particularly advantageous.

Figure 3:
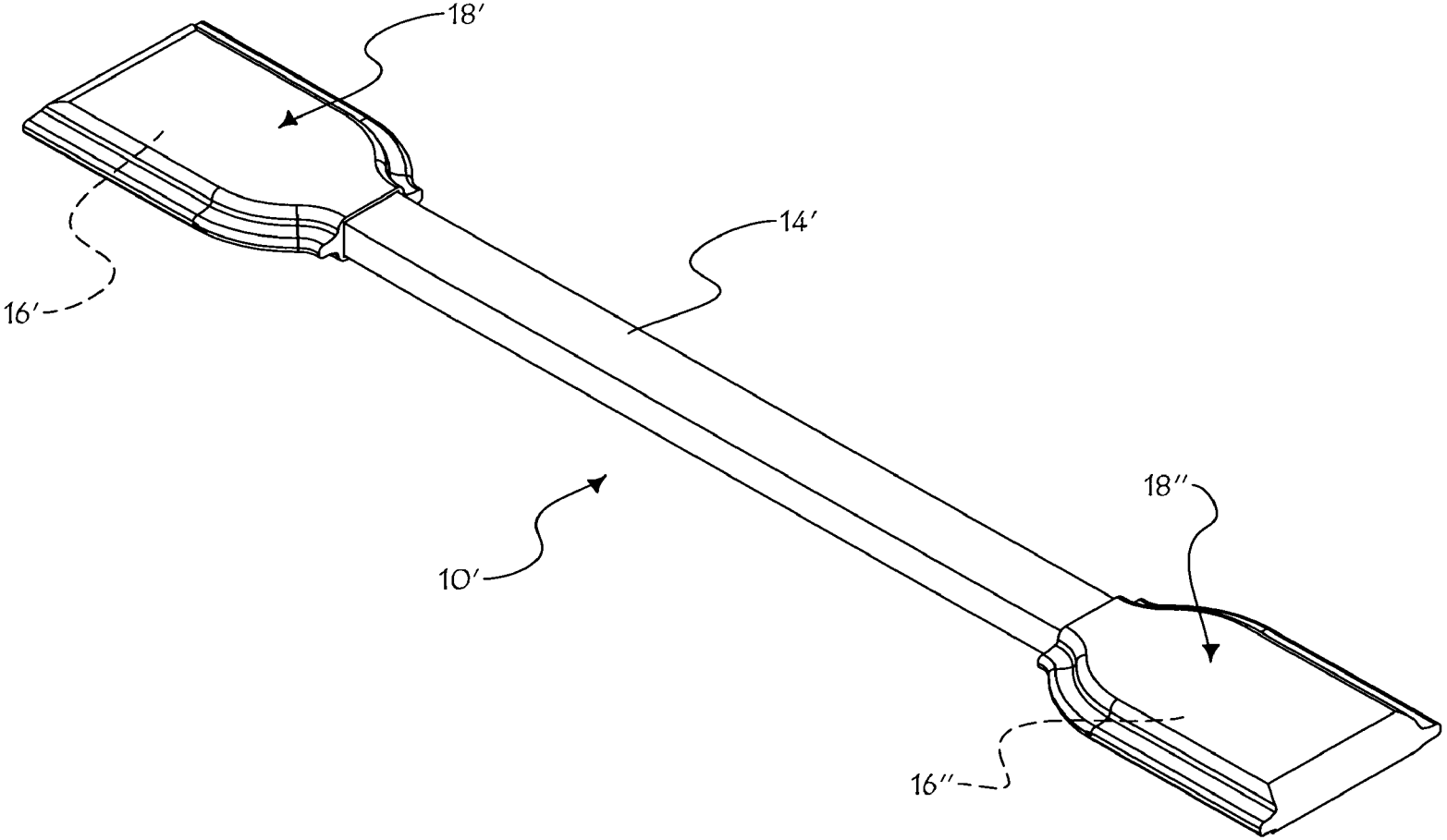
FIG. 3 is a view similar to FIG. 2, but showing a second embodiment of cleaning swab according to the present invention.
Figure 4:
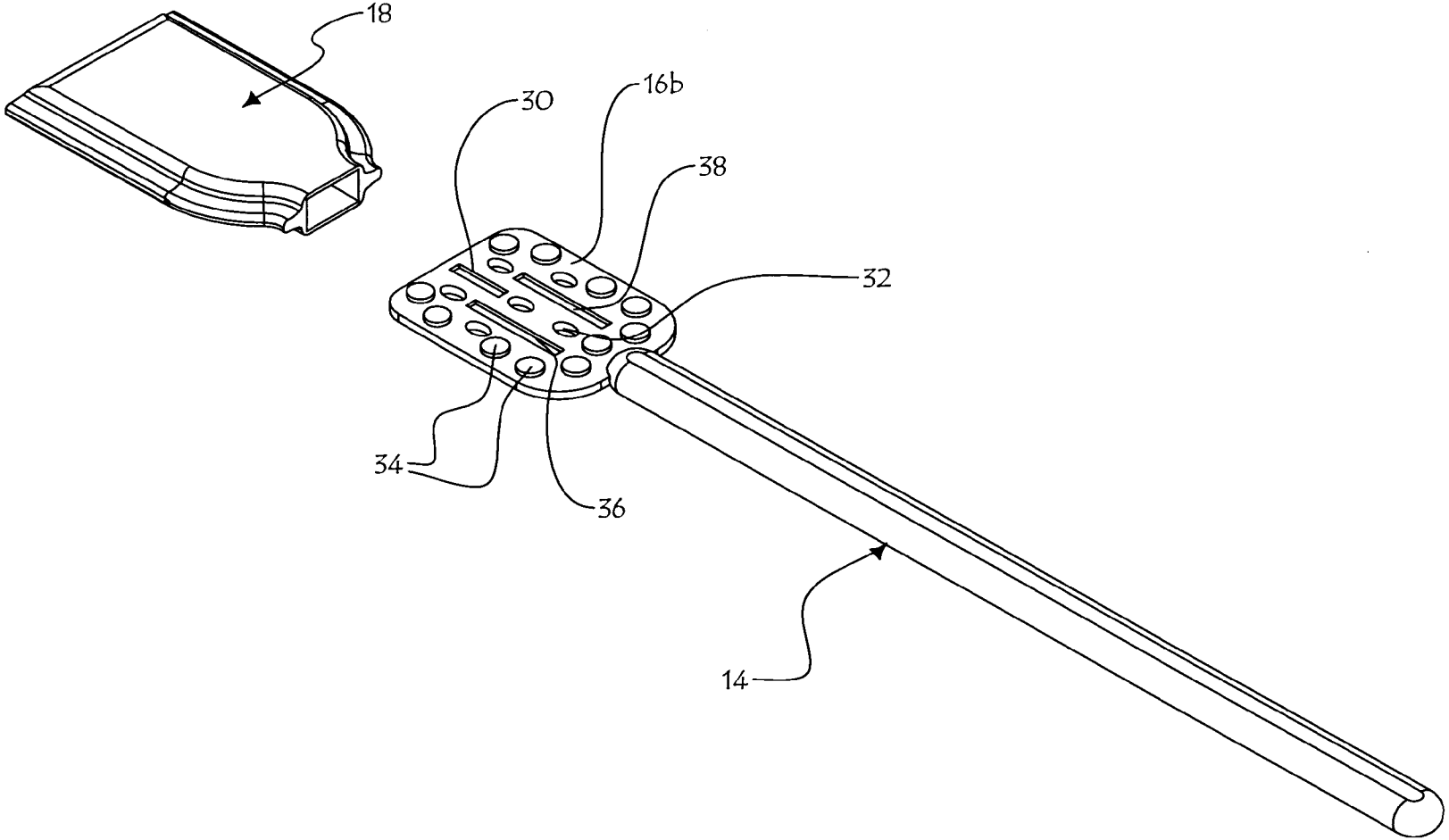
FIG. 4 is a view similar to FIG. 1, but with the cleaning swab rotated half a turn.

In the second embodiment of cleaning swab 10' of FIG. 3, a second blade 16' is added to handle 14' at the end of handle 14' opposite, and another fluid absorbing pocket member 18" is snugly mounted around a second blade 16".

It is understood that the cleaning swab of the present invention could be used for cleaning any delicate surface, such as the external surface of the rear and front elements on a DSLR lens, the glass of a flatbed scanner, etc.

It is noted that the particular shape or size of channels 20 may vary, since mitigation of fluid oversaturation at the level of the fluid absorbing pocket member 18 (18') is sought. Channels 20 may be holes, or alternately surface grooves made on one or both main surfaces of blade 16, or a combination of through holes and surface grooves. The elongated groove 14*a* in the handle 14 could cooperate under capillary forces with the channel means 20 in drawing fluids away from blade 16 and along handle 14. What is sought is to thus to substantially prevent surface smear of the external sensor or lens structure to be cleaned by cleaning swab 10 from fluid dripping under gravity forces upon fluid over-saturation of the cloth material constituting the swab blade pocket 18.

I claim:

1. An anti-smear cleaning swab for cleaning delicate surfaces, comprising a body defining an elongated handle having one end and another end opposite said one end thereof, an enlarged blade edgewisely carried at said handle one end and having one face and another face opposite said one face and a peripheral edge joining said one face and said another face, channel means provided integral to said blade and enabling fluid flow about at least one of said one face and of said another face of said blade, a fluid absorbing pocket generally enclosing said blade and sized to fit snugly therearound; and wherein said fluid absorbing pocket is made from a piece of folded lint-free sheet fabric, positioned relative to said blade such that a fold line of said sheet fabric is positioned adjacent a substantial portion of said blade peripheral edge, said sheet fabric being secured to said blade by hot sealing of a fraction of said blade peripheral edge.

2. A cleaning swab as in claim 1, wherein said channel means consists of at least a few passageways extending through said blade and opening into said one face and into said another face of said blade.

3. A cleaning swab as in claim 2, wherein at least sonic of said passageways are sized and shaped to enable fluid droplet retensive capture between said one face and said another face of said blade.

4. A cleaning swab as in claim 2, wherein said passageways are selected from the group comprising circular holes, oblong channels, and slots.

5. A cleaning swab as in claim 3, wherein said passageways are selected from the group comprising circular holes, oblong channels, and slots.

6. A cleaning swab as claim 1, wherein said channel means are selected from the group comprising grooves made on at least one of said one face and another face of said blade, and protrusions integrally projecting from at least one of said one face and another face of said blade.

7. A cleaning swab as in claim 1, further including an elongated groove, extending lengthwisely of said handle, said handle groove cooperating with said blade channel means in promoting fluid escape from said fluid absorbing pocket.

8. A cleaning swab as in claim 7, wherein said handle groove is sized and shaped to enable fluid flow under capillary forces of a fluid about an oversaturated said fluid absorbing pocket from said blade along said handle away from said blade.

* * * * *